US006142695A

United States Patent [19]

Byun

[11] Patent Number: 6,142,695

[45] Date of Patent: Nov. 7, 2000

[54] COSMETIC BRUSH

[76] Inventor: Young Kwang Byun, 371-1, Kogangbon-dong, Ojung-gu, Puchun-city Kyungki-do, Rep. of Korea

[21] Appl. No.: 09/450,987

[22] Filed: Nov. 29, 1999

[30] Foreign Application Priority Data

Dec. 15, 1998 [KR] Rep. of Korea ..... 98-25057
Jul. 29, 1999 [KR] Rep. of Korea ..... 99-15353

[51] Int. Cl.[7] ..... A46B 11/02

[52] U.S. Cl. ..... 401/188; 401/269; 401/187

[58] Field of Search ..... 401/188, 187, 401/269, 270, 282, 286, 287

[56] References Cited

U.S. PATENT DOCUMENTS 1,067,596 7/1913 Fesler ..... 401/269
1,091,228 3/1914 MacKelvey ..... 401/269
1,268,976 6/1918 Johnston ..... 401/269
1,936,724 11/1933 Lupo ..... 401/188
2,268,740 1/1942 Cory ..... 401/188

*Primary Examiner*—David J. Walczak
*Attorney, Agent, or Firm*—Ezra Sutton

[57] ABSTRACT

A cosmetic brush with a large number of soft hairs, an inner cylinder having soft hairs on its front end and holding cosmetic powder in it, and a pressure pump joined to the inner cylinder's rear end and supplying air to spray the cosmetic powder toward the soft hairs, the cosmetic brush including a sliding cylinder slidingly put on the inner cylinder's outer surface to cover the soft hairs, and a protective cap covering the sliding cylinder's front end and slidingly enclosing the soft hairs along with the sliding cylinder to protect the soft hairs, thereby preventing the soft hairs from being easily soiled and worn away.

3 Claims, 5 Drawing Sheets

COSMETIC BRUSH

BACKGROUND OF THE INVENTION

1. Field of the Invention

The present invention relates to a cosmetic brush. More particularly, it relates to a cosmetic brush whose soft hairs are not exposed to the outside to be hardly soiled or worn away.

2. Prior Art

A common-type cosmetic brush holds cosmetic powder in it and supplies that powder directly during use so there is no need to carry the brush and the cosmetic powder, individually. The conventional cosmetic brush has a large number of soft hairs on one side, an inner cylinder holding cosmetic powder in it, and a pump providing air to the inner cylinder to spray the powder toward the soft hairs in a manner that the powder is directly provided to a user's skin through the soft hairs. However, the soft hairs of this conventional cosmetic brush are always exposed to the outside, and are easily worn out and soiled.

SUMMARY OF THE INVENTION

Accordingly, the present invention is directed to a cosmetic brush that substantially obviates one or more of the problems due to limitations and disadvantages of the related art.

An object of the present invention is to provide a cosmetic brush whose soft hairs are exposed only during use and covered for protection when they are not used, thus preventing them from being stained and worn away easily.

Another object of the present invention is to provide a cosmetic brush that does not require powder refill and facilitates filter cleaning and filter replacement.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a cosmetic brush with a large number of soft hairs, an inner cylinder having the soft hairs on its front end and holding cosmetic powder in it, and a pressure pump joined to the inner cylinder's rear end and supplying air to spray the cosmetic powder toward the soft hairs, including a sliding cylinder slidingly put on the inner cylinder's outer surface to cover the soft hairs; and a protective cap covering the sliding cylinder's front end and slidingly enclosing the soft hairs along with the sliding cylinder to protect the soft hairs.

Preferably, the soft hairs are integrally formed with the inner cylinder. The soft hairs are joined to a coupling chamber having a threaded portion at its rear end, and the inner cylinder has a threaded portion at its front end's inner surface so that the inner cylinder and the coupling chamber can be screwed to each other and separated from one another.

It is preferable that the inner cylinder has seal covers each attached to its both ends, and is unit-packed so as to be replaced with a new inner cylinder holding cosmetic powder after removing the inner cylinder from the soft hairs and coupling chamber when the cosmetic powder in the inner cylinder is used up.

The sliding cylinder has guide protrusions at its inner surface, and the inner cylinder has corresponding guide grooves longitudinally formed along its outer surface so as to make the guide protrusions be inserted into the guide grooves and be moved along them.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

In the drawings:

FIG. 1 is an exploded-perspective view of a cosmetic brush in accordance with a first preferred embodiment of the present invention;

FIGS. 2*a* and 2*b* are each sectional views showing a sliding cylinder of the cosmetic brush in accordance with the first preferred embodiment of the present invention;

DETAILED DESCRIPTION OF PREFERRED EMBODIMENT

Reference will now be made in detail to the preferred embodiments of the present invention, examples of which are illustrated in the accompanying drawings.

Figure 1:
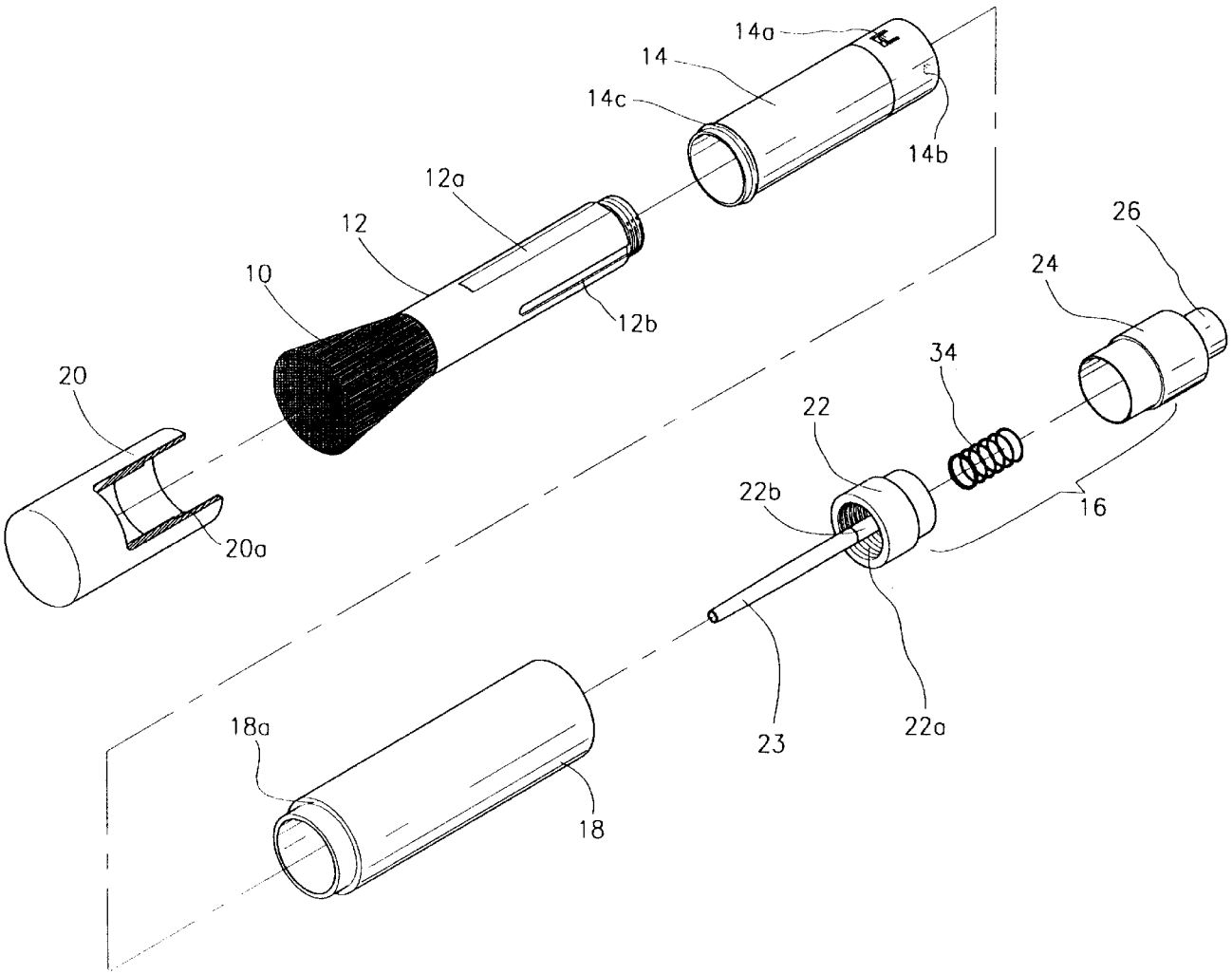
Figure 2A:
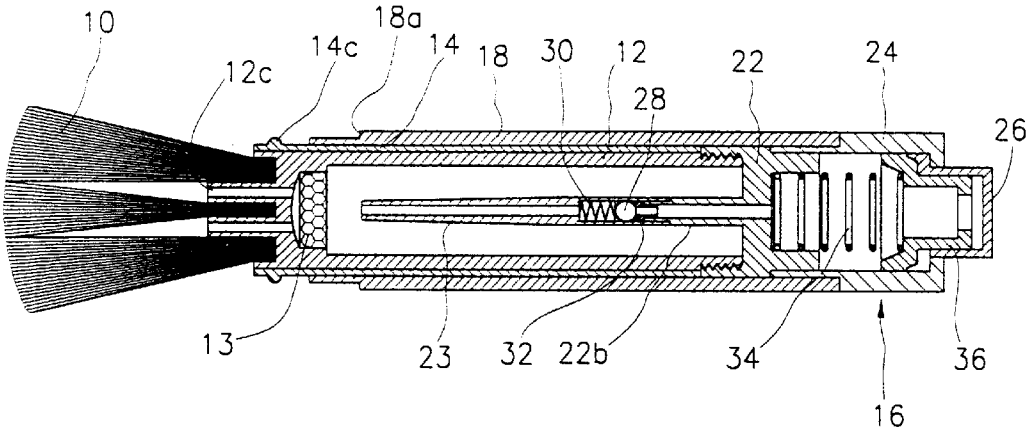
Figure 2B:
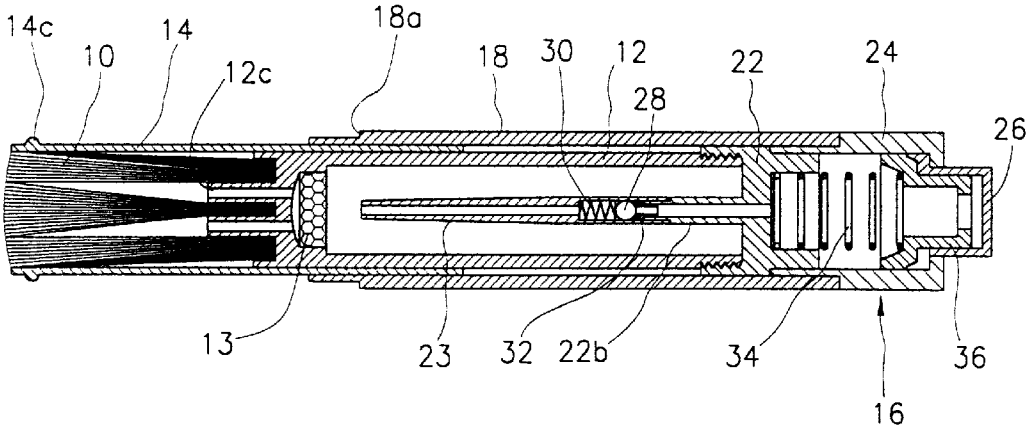
Figure 3:
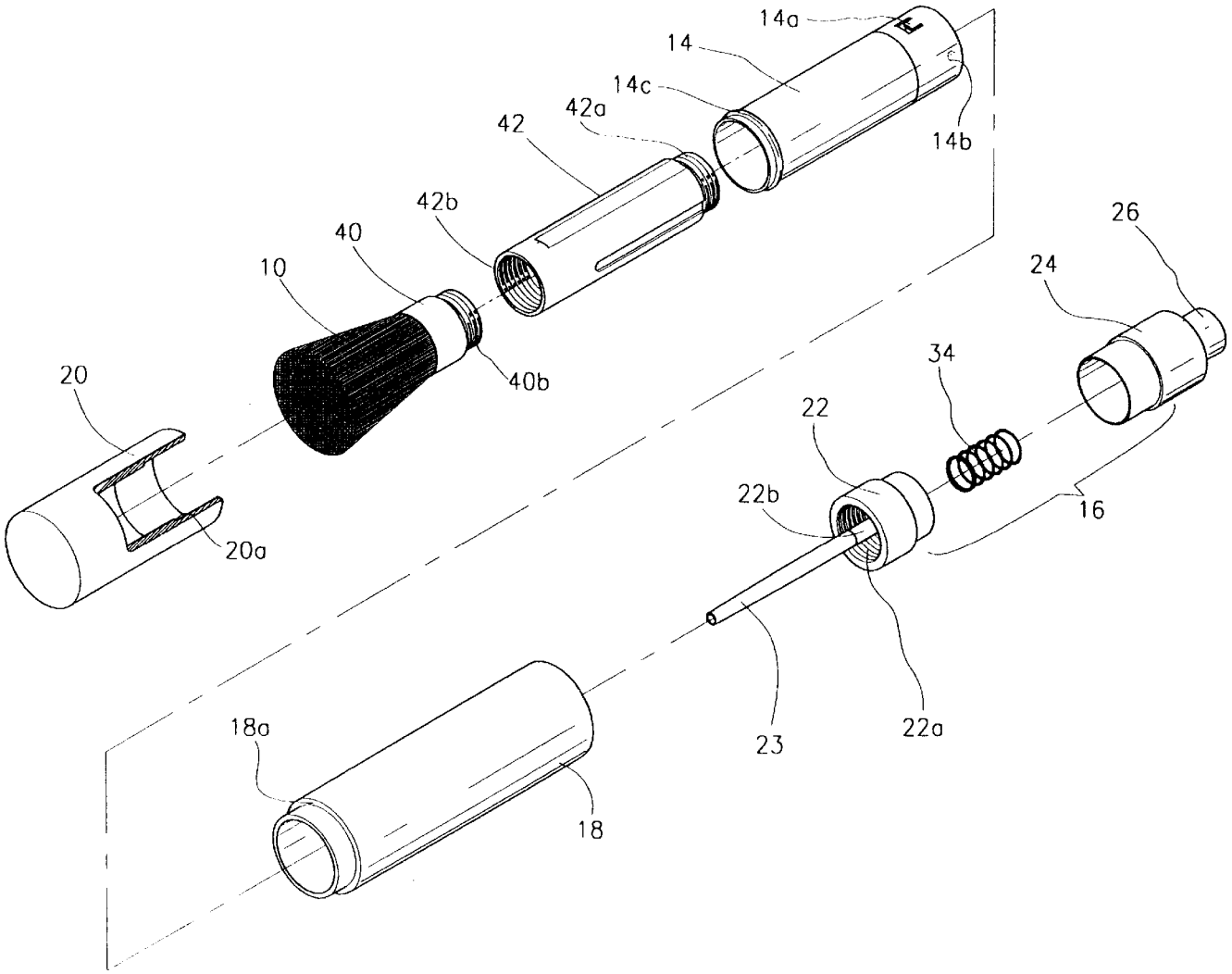
FIG. 3 is an exploded-perspective view of a cosmetic brush in accordance with a second preferred embodiment of the present invention.
Figure 4:
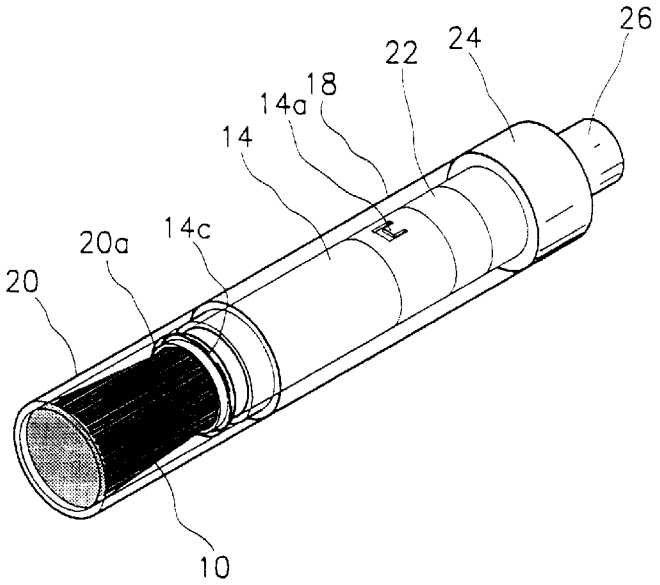
FIG. 4 is a coupling-perspective view of the cosmetic brush in accordance with FIG. 3's preferred embodiment.
Figure 5:
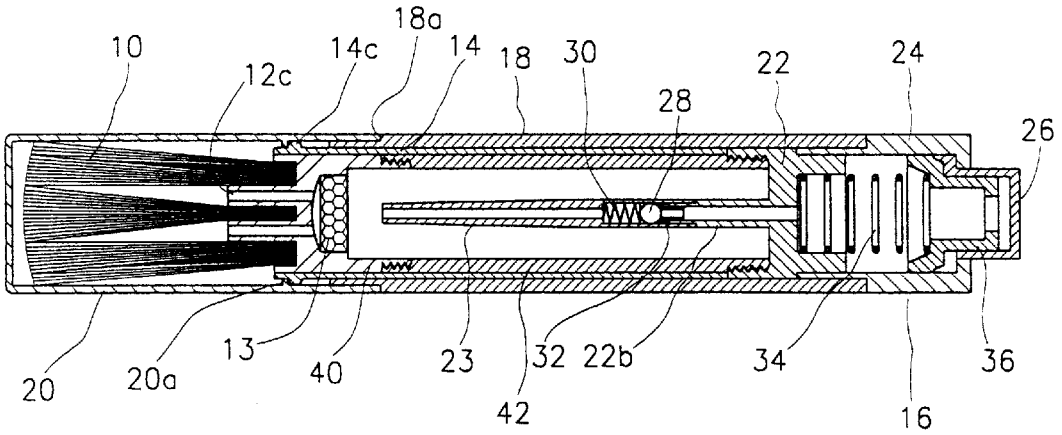
FIG. 5 is a sectional view of the cosmetic brush in accordance with FIG. 3's preferred embodiment.
Figure 6:
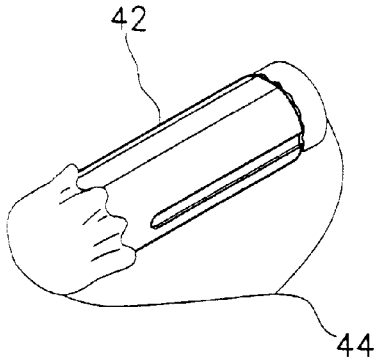
FIG. 6 is a perspective view of an inner cylinder unit-packed coupled to the cosmetic brush in accordance with FIG. 3's embodiment.
Figure 7:
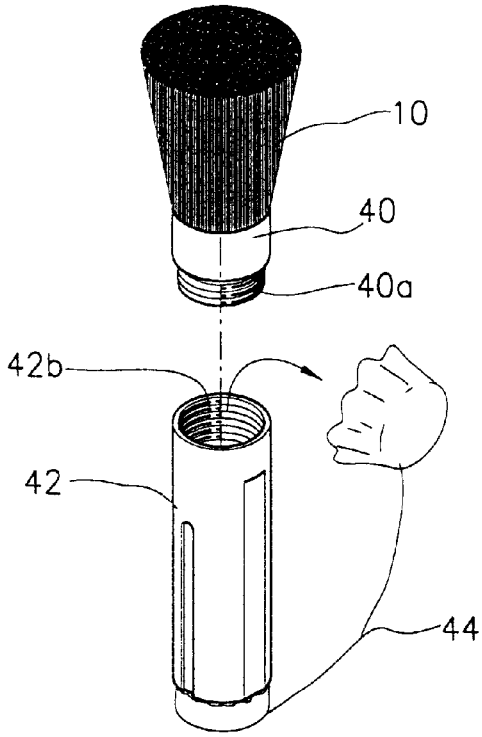
FIG. 7 is a perspective view of the inner cylinder's coupling state in accordance with FIG. 6.

As shown in FIGS. 1 to 2*b*, the inventive cosmetic brush in accordance with a first preferred embodiment of the present invention includes a large number of soft hairs 10; an inner cylinder 12 connected to soft hairs 10 at one end and opened at the other end; a sliding cylinder 14 slidingly putting on and enclosing the outer surface of inner cylinder 12; a pressure pump 16 connected to the opened other end of inner cylinder 12; an outer cylinder 18 enclosing sliding cylinder 14; and a protective cap 20 covering soft hairs 10.

The soft hairs 10 are formed to be pliable enough to directly contact a user's skin, and integrally coupled to the inner cylinder 12 at one end. The inner cylinder 12 has a hollow inside to be supplied with cosmetic powder, and the other end that is an opened circular tube and has a threaded portion for coupling a pressure pump 16 at its outer surface.

The inner cylinder 12 has friction guide planes 12*a* formed longitudinally along its outer surface to guide each friction guides 14*a* of sliding cylinder 14, and guide grooves 12*b* formed apart from friction guide planes 12*a* to guide guide protrusions 14*b* of sliding cylinder 14. Each friction guide plane 12*a* is 90° opposed to each guide groove 12*b*, and each guide groove 12*b* is formed to a length enough to let sliding cylinder 14 slide to brush 10 and stop at a point where it completely encloses soft hairs 10. A plurality of injection holes 12*c* are provided to a portion to which soft hairs 10 of inner cylinder 12 are provided so as to jet out cosmetic powder to the outside through soft hairs 10. A filter 13 is formed to block inner cylinder 12 so as to supply an appropriate amount of the cosmetic powder. The filter 13 is preferably made of polyester foam or sponge. Sliding cylinder 14 has a through passage inside to be put on the outer surface of inner cylinder 12; friction guides 14*a* moved along inner cylinder 12's friction guide planes 12*a*, respectively; and guide protrusions 14*b* guided along guide grooves 12*b* of inner cylinder 12.

Fastening projections 14*c* are formed along the outer surface of sliding cylinder 14 on the opposite side of friction guides 14*a* so as to mate with a jaw 20*a* of protective cap 20.

The pressure pump 16 has a threaded portion 22*a* at an inner surface to mate with inner cylinder 12's corresponding portion, a chamber 22 with a long rounded pipe 22*b* in the middle, a rear cap 24 covering one side of this chamber 22's outer surface, and a push button 26 partially inserted into rear cap 24 at one side and exposed to the outside at the other side so as to compress air pressure by a tube 23.

This tube 23 is extended to the front of filter 13 and coupled to the pipe 22*b* of chamber 22 to supply the cosmetic powder to filter 13 by the air pressure compressed by push button 26. Inside tube 23 is provided a check valve in order to prevent the powder from flowing back to push button 26 through tube 23 in the middle of inhaling the air while push button 26 is pressed and returns to its original state. Tube 23 has a ball 28 and a spring 30 provided in front of ball 28 to move ball 28 resiliently.

A sealing member 32 is provided to the pipe 22*b*'s front end to seal the pipe 22*b*. An elastic spring 34 is interposed between chamber 22 and push button 26 to make pressed push button 26 return to its original state, and a packing rubber 36 comes in close contact with the rear cap 24's inner surface at its lower end while being fitted into push button 26 and rear cap 24 to prevent air leakage.

The outer cylinder 18 has a hollow inside to enclose sliding cylinder 14, one end closely coupled to rear cap 24 of the pressure pump 16, and the other end with a threshold 18*a* on which protective cap 20's end portion is caught.

The protective cap 20 has one closed end to cover and protect soft hairs 10, and jaw 20*a* formed at the inner surface of the opened front end so as to mate with sliding cylinder 14's fastening projections 14*c*.

The inventive cosmetic brush is made by supplying the cosmetic powder to inner cylinder 12's interior, coupling the opened one end of inner cylinder 12 to the pressure pump 16's chamber 22 to form a seal, and then putting sliding cylinder 14 and outer cylinder 18 on the outer surface of inner cylinder 12.

Once a user removes the protective cap 20 from soft hairs 10, those soft hairs 10 are exposed to the outside and unfold. The sealed inner air is compressed by pressing push button 26 of the pressure pump 16, and flows to tube 23 through chamber 22's pipe 22*b*, thus pushing ball 28 and forcing the cosmetic powder in inner cylinder 12 to filter 13.

As push button returns to its original state by elastic spring 34, ball 28 returns to its original position and closely contacts sealing member 32 to prevent the powder from flowing backward. In this manner, an appropriate amount of the powder in the brush is supplied to soft hairs 10 through filter 13 by pressing push button 26 several times.

When putting the protective cap 20 on soft hairs after use, sliding cylinder 14's front end is pulled to collect unfolded soft hairs 10 to enclose them, and sliding cylinder 14 slides to its original state by putting and pulling the protective cap 20 on sliding cylinder 14's front end in such a manner that the protective cap 20 covers soft hairs 10.

Another preferred embodiment of the present invention will now be described referring to the drawings.

As shown in FIGS. 3 to 7, the inventive cosmetic brush according to another embodiment includes an inner cylinder 42 having one end removably coupled with a coupling chamber 40 with soft hairs 10 integrally coupled therewith, and an opened other end, a sliding cylinder 14 covering soft hairs 10 of coupling chamber 40, a pressure pump 16 connected to inner cylinder 42's opened end, an outer cylinder 18 enclosing sliding cylinder 14, and a protective cap 20 covering soft hairs 10.

Redundant descriptions of features common between the first and second preferred embodiments of the present invention are omitted.

The inner cylinder 42 of long circular pipe has a threaded portion 42*a* at an outer surface of its one side to mate with the pressure pump 16, a threaded portion 42*b* at an inner surface of its other side to mate with coupling chamber 40. The inner cylinder 42 holding cosmetic powder in it as an extra accessory is sealed by seal covers 44 such as silver paper at both ends, and used after removing the seal covers 44 and joining both ends to coupling chamber 40 and the pressure pump 16, respectively.

The coupling chamber 40 has a threaded portion 40*b* at the outer surface of one side to mate with threaded portion 42*b* of inner cylinder 42; a plurality of injection holes 12*c* formed on the front of a cylindrical part in the other side's middle. Soft hairs 10 are provided to the cylindrical part. A filter 13 is provided to coupling chamber 40's interior to control a supply of the cosmetic powder.

According to this preferred embodiment, once the cosmetic powder in inner cylinder 42 is used up, the inner cylinder 42 is separated from coupling chamber 40, a new inner cylinder filled with cosmetic powder is then joined to coupling chamber 40 so that the cosmetic brush can be reused. Filter 13 can be removed from coupling chamber 40 for cleaning and replacement. When joining a new inner cylinder to coupling chamber 40, after placing upward inner cylinder 42's end that is joined to coupling chamber 40, corresponding seal cover 44 is then removed from inner cylinder 42's end, and inner cylinder 42 is again connected to coupling chamber 40.

After reversing inner cylinder 42 again to face its other end to upward and removing the other seal cover 44, inner cylinder 42 is joined to pressure pump 16.

As described above, the inventive cosmetic brush has such sliding cylinder and protective cap to avoid the soft hairs from being abraded and getting dirty. In addition, the inner cylinder is smoothly removed from and rejoined to the coupling chamber with the soft hairs, thus solving the troubles of refilling cosmetic powder in the inner cylinder and facilitating filter cleaning and filter replacement.

The preferred embodiments of the present invention are given by way of example, and the invention recited in the attached claims is not limited to the illustrative embodiments. Those of ordinary skill in the art will recognize that routine design changes may be made to the exemplary embodiments without departing from the scope of the claims.

What is claimed is:

1. A cosmetic brush comprising:

a) an inner cylinder holding cosmetic powder therein and having an outer surface with a plurality of soft hairs connected thereto; a sliding outer cylinder slidingly placed on the inner cylinder's outer surface to cover said plurality of soft hairs; a pressure pump joined to a rear end of the inner cylinder and supplying air to spray the cosmetic powder toward the soft hairs;

b) said soft hairs are joined to a coupling chamber having a threaded portion at a rear end thereof, and said inner cylinder having a threaded portion at the front end thereof so that said inner cylinder and said coupling chamber can be screwed to each other and separated from each other;

c) said inner cylinder having seal covers; said seal covers attached to both ends of said inner cylinder prior to said inner cylinder being assembled to said coupling chamber and said pressure pump such that a new inner cylinder holding cosmetic powder can replace a used inner cylinder after removing said used inner cylinder from said soft hairs and said coupling chamber when the cosmetic powder in said used inner cylinder is used up; and d) a protective cap covering said sliding cylinder's front end and slidingly enclosing said soft hairs along with said sliding cylinder to protect said soft hairs.

2. A cosmetic brush according to claim 1, wherein the soft hairs are integrally coupled with the coupling chamber.

3. A cosmetic brush according to claim 1, wherein the sliding cylinder has guide protrusions at its inner surface, and the inner cylinder has corresponding guide grooves longitudinally formed along its outer surface so as to make the guide protrusions be inserted into the guide grooves and be moved along them.

* * * * *